US005718525A

United States Patent [19]

Bruhnke et al.

[11] Patent Number: 5,718,525

[45] Date of Patent: Feb. 17, 1998

[54] LABEL PRINTER AND DISPENSER

[75] Inventors: Bernd D. Bruhnke, Waukesha; Robert L. Schanke, New Berlin; Dean P. Stefanac, Brookfield, all of Wis.

[73] Assignee: Brady USA, Inc., Milwaukee, Wis.

[21] Appl. No.: 583,451

[22] Filed: Jan. 5, 1996

[51] Int. Cl.[6] ..... B41J 11/00

[52] U.S. Cl. ..... 400/586; 400/120.16; 400/593; 400/618

[58] Field of Search ..... 400/586, 593, 400/613, 618, 636, 120.16, 120.17

[56] References Cited

U.S. PATENT DOCUMENTS

| | | | |
|---|---|---|---|
| 1,825,395 | 9/1931 | Golje | 101/291 |
| 4,444,611 | 4/1984 | Becker | 156/384 |
| 4,561,921 | 12/1985 | Treiber | 156/297 |
| 4,614,949 | 9/1986 | Hakkaku et al. | 346/76 |
| 4,647,232 | 3/1987 | Costa | 400/120 |
| 4,676,680 | 6/1987 | Hauger et al. | 400/211 |
| 4,726,865 | 2/1988 | Treat | 156/349 |
| 4,842,660 | 6/1989 | Voltmer et al. | 156/64 |
| 4,972,207 | 11/1990 | Ishiyama et al. | 400/618 |
| 5,040,461 | 8/1991 | Van-Ocker | 101/288 |
| 5,162,069 | 11/1992 | Morris | 156/363 |
| 5,176,458 | 1/1993 | Wirth | 400/120 |
| 5,182,573 | 1/1993 | Kim | 346/1.1 |
| 5,264,066 | 11/1993 | Lundell | 156/361 |
| 5,300,160 | 4/1994 | Wilson et al. | 156/64 |
| 5,304,007 | 4/1994 | Flanagan | 400/120 |
| 5,304,264 | 4/1994 | Wehrmann | 156/64 |
| 5,306,375 | 4/1994 | Leonard | 156/249 |
| 5,309,176 | 5/1994 | Faes et al. | 346/76 |
| 5,372,440 | 12/1994 | Slater | 400/320 |

*Primary Examiner*—John S. Hilten
*Attorney, Agent, or Firm*—Whyte Hirschboeck Dudek S.C.; Timothy J. Ziolkowski

[57] ABSTRACT

A method and apparatus is disclosed for printing and dispensing labels for precise and accurate placement on an article. The present invention also minimizes label queue and the distance between the point of printing and the point of label dispensing. The invention has a retractable print head for printing information on a label while the label moves from a preprinting position to a fixed label dispensing position. The print head is movable to a dispensing position thereby allowing access to the printed label at the fixed label dispensing point by a transfer device. A dispenser having a stripper plate is provided to receive the web having the printed label thereon from the print head while in a printing position. The stripper plate strips the liner from the printed label after the transfer device comes in positive contact with the printed label by moving to a dispensing position. The printed label can then be placed on an article with extreme accuracy. It is contemplated that the present invention is particularly useful in applying printed labels, such as bar codes, to circuit boards, although many other applications will benefit from the present invention.

20 Claims, 6 Drawing Sheets

LABEL PRINTER AND DISPENSER

BACKGROUND OF THE INVENTION

1. Field of the Invention

The present invention relates generally to label printing and dispensing, and more particularly to an apparatus and method for printing labels as they move across a retractable print head and thereafter dispensing the labels using a dynamic stripper plate.

2. Description of the Prior Art

Numerous types of label applicators are available and used in various industries for applying adhesive-backed labels to articles. The labels are typically provided on rolls of release liner on which the individual labels are spaced apart and removably attached to the liner, also referred to as a label tape, by an adhesive coated surface of the labels. The label and liner combination is frequently referred to as a web. The labels may be preprinted on their nonadhesive, outwardly facing surfaces. A roll of label-bearing liner is mounted on a reel and passed through some form of stripping device for removing the individual labels from the release liner. A transfer device can then apply the printed labels to articles passing by the label applicator on a continuously moving conveyor. The empty liner is subsequently wound onto a take-up reel. For those labels which are not pre-printed, various types of printing mechanisms may be used for continuous printing. In these instances, the labels are pre-positioned on the liner and printed as the labels pass a print head. The liner carrying the printed labels is then guided to a label stripping station where the printed labels are stripped and applied to articles.

One type of printing and labeling process is called "on demand" label printing, wherein a specific label is printed and applied before the subsequent label is printed. On demand printing is useful for devices in which each label is different and the information required for printing a given label may not be available before the previous label has been printed and dispensed. For example, on demand labeling is desirable in devices which determine the weight of an individual article and print a specific label based on that article's weight. On demand label printing is also beneficial if a given label is incorrectly printed or misapplied to an article, requiring a new label with the correct information be printed and applied. A drawback to the on demand label printing devices taught in the prior art is that the physical characteristics of the labeling device, namely the interference between the label printing mechanism and the label stripping mechanism, often dictate that the labels be separated along the liner by a certain distance, termed the "dead zone" or "label gap". Specifically, the label gap is the distance between the print line of the print head and the point where labels are stripped from the liner. This distance is of particular importance since it defines an unusable portion of label space which is not available for printing.

This label gap can be overcome if the labels are not printed on demand. In other words, if a label queue is allowed to form between the print line and the point where labels are stripped from the liner, the labels can then be positioned on the liner in an edge-to-edge relationship such that there is no wasted space between the labels. In this case, the number of printed labels in the queue is dictated by the length of the labels and the distance between the print line and the point where labels are stripped from the liner. As long as the length of the labels is less than the distance between the print line and stripping point, this type of label printing results in a positive label queue. However, labeling devices which exhibit a positive label queue are undesirable where each label is different and the information required for printing a given label may not be available before the previous label has been printed and dispensed. Additionally, if a label printed with a labeling device having a positive label queue is misprinted or misapplied, it becomes difficult to reprint a label because both the labeling device and the article delivery system, with which the labeling device operates, must be interrupted. Alternatively, if such an interruption is unacceptable, a label must be printed separately and applied by hand.

Once a label has been printed, various types of mechanisms may be used to remove the label from the liner, move the label into a labeling position and apply the label to an article. The most common method of removing adhesive-backed labels from a liner is to bend the liner away from the label so as to form a small radius shear line between the label and the liner. The label is peeled off along the shear line by pulling the liner and the label away from each other. Typically, mechanisms employing this procedure are provided with a surface around which the label bearing liner is directed. As the liner is passed around the surface, an acute angle is formed between the surface and the label such that the leading edge of the label passing over the surface is disengaged from the release liner. The adhesive coated surface of the leading edge of the label is then contacted with the surface of a moving article carried on the conveyor such that further movement of the article by the conveyor peels the remainder of the label from the liner and transfers the label onto the article. A wiper or roller may also be employed to provide pressure to the nonadhesive side of the label, thus ensuring that the label is securely fastened to the article.

Alternatively, a transfer device may be used to peel the label away from the liner and subsequently move the label into contact with an article moving along a conveyor. Typically, the transfer device draws a vacuum so that the nonadhesive coated surface of the label can be held against a vacuum screen or pad during transfer from the label pick-up position to the label dispensing position. The transfer device engages the leading edge of the label to separate it from the liner. Further movement of the transfer device is used to separate the trailing portion of the label from the liner. Once the transfer device has moved a label into contact with an article, the vacuum will be released so that the label adheres to the article. A positive air stream may be applied to project the label onto the article. This is an acceptable method of removing labels from a liner where extreme accuracy of label placement is not necessary. Since the transfer device is used for peeling the label, the printed label may become misaligned or cocked on the transfer device and result in crooked label on the article.

There are several printing and stripping devices in the prior art which exhibit either a positive label queue or on demand printing mechanisms such as those described above. U.S. Pat. No. 4,726,865 teaches a combination of a printing mechanism with a label peeler and dispenser mechanism for use with a conveyor-type article moving system. Information is printed on a label by a thermal printer having an array of individually energized heater elements which are selectively activated. The printer, located adjacent a pin around which the label bearing liner is guided, can be commanded via a processor to imprint labels as they travel past the printer. The mechanism is provided with a scale which measures the weight of articles so that each individual label can be printed with specific weight information relating to the article to which the label is applied. As the liner changes direction around the pin, the label is released from the liner and simultaneously contacted by a vacuum port located on the end of a label pickup arm which uses a negative pressure to hold the label as the arm is swung into a label application position. One drawback to this "on demand" printing and stripping mechanism is that the pin and the print line are separated by a positive distance such that a label gap between labels is necessary to achieve the on demand printing.

U.S. Pat. No. 4,726,865 teaches a positive queue labeling mechanism which combines a printing mechanism with a label peeler-dispenser mechanism for use with a conveyor-type article moving system. The printer is disclosed as an option which can be included with the labeling dispenser. A printer located adjacent an impact bar can be commanded via a processor to print labels as they travel past the printer. The device may also be provided with means for sensing or determining the property of a product so that such information can be printed on specific labels destined for specific articles. Printed labels are subsequently stripped from the liner by a rotating vacuum applicator drum which applies the labels to articles passing adjacent the drum. As pointed out above, a drawback to such a device is that in instances where a label is misprinted or misapplied, the labeling process must be interrupted while the error is corrected.

One prior art device which has attempted to decrease label gap between printed labels by altering the geometry of the peel bar is U.S. Pat. No. 5,040,461. This patent teaches use of a thermal ribbon-type printing head which pivots up and down to print labels against the outer periphery of a resilient drum platen. The labels are stripped from the liner by moving the web around a triangular-shaped peel bar after which a blast of air carries the printed label to an applicator pad. The triangular shape of the peel bar permits printed labels to be stripped much closer to the site of printing than is typically permitted by conventional flat peel bars having a rectangular geometry. Therefore, the label web may be provided with a substantially smaller label gap resulting in a consequent savings of label stock because labels can be located closer together on the liner. However, the reliance of compressed air to carry the printed label to the applicator pad, and the absence of positive label contact, introduce a degree of inaccuracy that is unacceptable for precise label placement.

One type of stripping mechanism which may be useful in decreasing the label gap between labels is described in U.S. Pat. No. 5,300,160. This patent teaches a pre-printed label transfer device which holds a label fixed while a stripping plate and roller are used to draw a label-bearing liner away from the label. Specifically, a label carried on a label-bearing liner is positioned adjacent a slidable stripping plate. A vacuum applicator head is used to hold the label fixed in that position while the stripping plate is retracted from a first position to a second position such that the liner is pulled away from the label and the label is ready for application by the vacuum applicator head. However, because of the physical configuration and position of the slidable stripping plate and vacuum applicator head, the use of conventional printing heads will exhibit either a positive label queue or an unacceptable label gap between labels.

Therefore, the need exists for a label printing and stripping mechanism which can print labels on demand, i.e., with no positive label queue, minimize the label gap between adjacent labels, and provide for accurate and positive label transfer. It would also be desirable for the device to reprint labels which have been misprinted or misapplied without the need to interrupt either the operation of the labeling mechanism or the article moving system with which it operates. Additionally, such a device should print labels clearly and efficiently without dependency on the type of printing method employed.

SUMMARY OF THE INVENTION

These and other objectives are achieved in the present invention. The invention provides a device and method for printing and dispensing labels without a positive label queue by minimizing the distance between the print line and the point of label stripping. The invention also offers the printed label for transferring to an article in a precise and accurate orientation.

In accordance with one aspect of the invention, a printer and dispenser for printing labels on a label-bearing liner, and then dispensing the printed labels from the label-bearing liner includes a retractable print head attached to a frame assembly that is moveable between a printing position and a dispensing position. A stripper plate is slidably attached to the frame assembly and is also moveable between a printing position and a dispensing position. The printer and dispenser assembly has a pair of stationary rods that act as a supply spool, and a rewind spool that is rotatably attached to the frame assembly. The stationary rods are provided to carry a roll of label-bearing liner which is threaded through a tensioning device, a label sensor, the print head, the stripper plate, between a drive roller and a nip roller, and to the rewind spool. A motor is provided for unwinding the label liner from the supply roll, through the printer and dispenser assembly, and rewinding onto the rewind spool. The motor advances each of the labels on the label liner across the print head from a pre-printing point to a fixed label dispensing point, and since both the print head and the stripper plate move with reference to the frame assembly and the labels, printed labels can be provided with a substantially zero label queue.

During operation, the print head prints information on a label as the label passes from the pre-printing point across the print line, and to the fixed label dispensing point while the print head is in the printing position. The label liner is advanced by approximately the length of one label and any associated label gap. The label sensor tracks the labels on the label liner and provides label placement information to a microprocessor control. The print head is then retracted to a dispensing position, allowing access to the printed label at the fixed label dispensing point by a transfer device. The transfer device is brought into positive contact with the printed label and holds the label while the stripper plate slides rearward to strip the liner from the label while moving to its dispensing position, thereby allowing removal and precise placement of the printed label by the transfer device.

In accordance with another aspect of the invention, a method of printing and dispensing labels from a label bearing liner includes establishing a fixed label dispensing point and step-wise advancing a label on the label liner across the print head and onto the stripper plate, thereby aligning the label with the fixed label dispensing point. Information is printed on the label as it advances across the print head. The method includes moving the print head sufficiently away from the fixed label dispensing point to provide access to the printed label by a transfer device. The label liner is tensioned across the fixed label dispensing point, and the transfer device is placed in positive contact with the printed label. The method next includes the step of sliding the stripper plate in an opposite direction as that of the label liner advancement, thereby peeling the label liner from the printed label while maintaining the printed label at the fixed label dispensing point. The transfer device can then accurately remove the printed label and apply it to an article.

Because of the aforementioned arrangement and method, the present invention provides extremely accurate picking and placing of printed labels since the transfer device is brought into contact with a printed label before any attempt to strip, or peel the liner from the label. In this manner, the transfer device, typically a vacuum applicator head, comes into positive contact with the printed label before the printed label has an opportunity to become misaligned, as is often the case with prior art label dispensers. Therefore, because of this extremely accurate placement, it is contemplated that the present invention will find particular usefulness in applying printed labels, such as bar codes, to printed circuit boards. Also, since the print head is sufficiently moved away from the fixed label dispensing point, the present invention maintains a substantially zero label queue during the printing and dispensing of labels to articles and minimizes label gap and maximizes the number of labels on the label liner. The misalignment of printed labels is therefore virtually eliminated, and the number of labels printed per web roll is maximized.

Various other features, objects, and advantages of the invention will be made apparent from the following detailed description, taken together with the drawings.

BRIEF DESCRIPTION OF THE DRAWINGS

The drawings illustrate the best mode presently contemplated for carrying out the invention. In the drawings.

DETAILED DESCRIPTION OF THE PREFERRED EMBODIMENT

Figure 1:
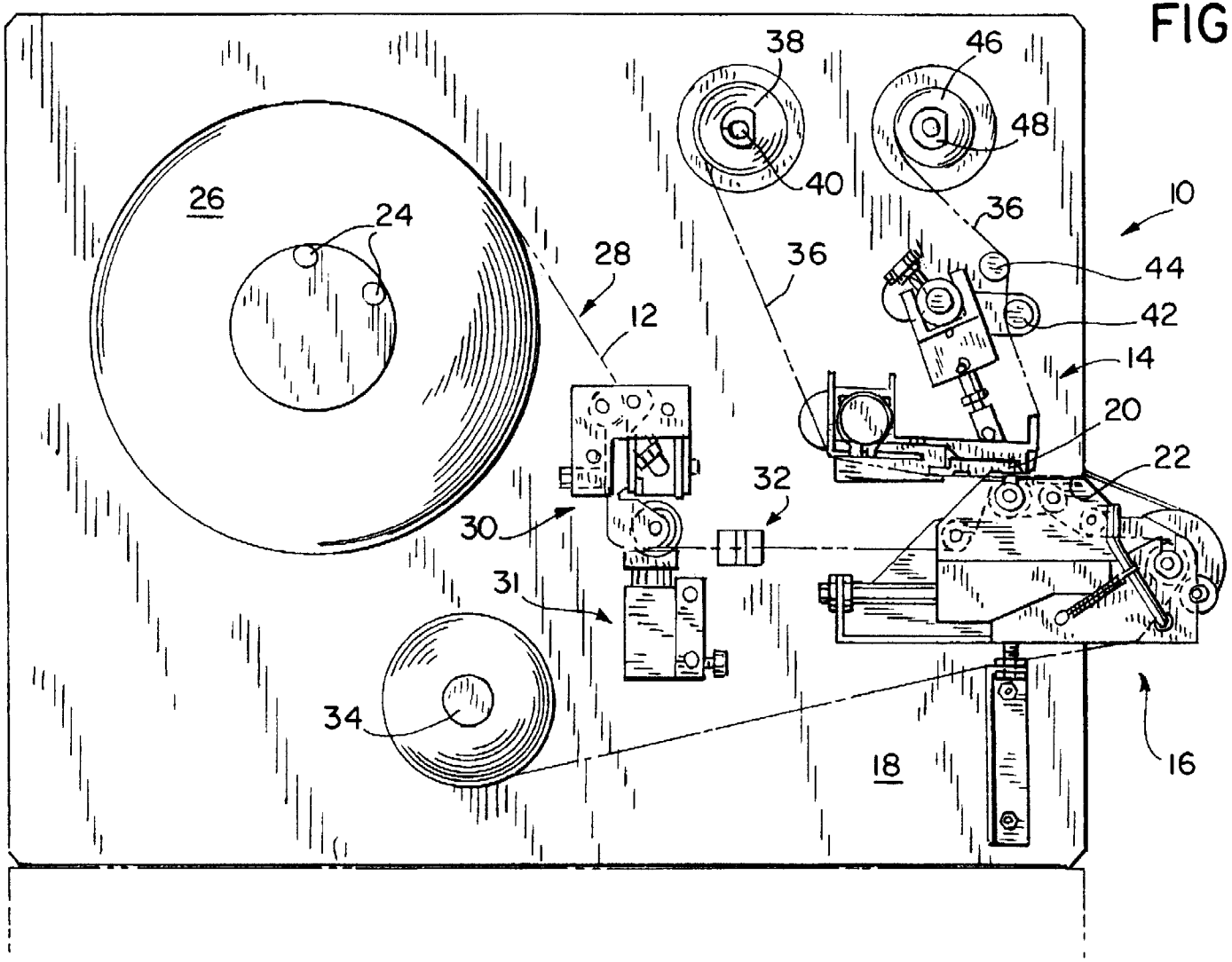
FIG. 1 is a side view of the printer and dispenser of the present invention.

FIG. 1 shows a printer and dispenser assembly 10 for printing labels on a label liner 12 and dispensing printed labels. The printer and dispenser assembly 10 has a print head assembly 14 and a dispenser 16 mounted to a frame assembly 18. The print head assembly 14 has a retractable print head 20 movably attached to the frame assembly 18. The dispenser 16 has a stripper plate 22 slidably attached to the frame assembly 18. The printer and dispenser assembly 10 has a pair of stationary rods 24, which act as a supply spool, for carrying a supply roll of label liner 26 thereon. Label liner 12 has a series of labels removably attached with adhesive from an upper face 28 of label liner 12. The label liner 12 is unwound from supply roll 26 and is advanced forwardly through a high web tensioner 30, across a low web tensioner 31, through a label sensor 32, through the dispenser 16 and across the print head 20, and rewound on a rewind spool 34.

In a preferred embodiment, the printer and dispenser assembly 10 uses a thermal print head requiring thermal ribbon 36 from a ribbon supply spool 38 on supply spindle 40. Thermal ribbon 36 is brought around print head 20, between the print head and label liner 12. Thermal ribbon 36 is guided around a ribbon slack roller 42 and a guide roller 44, to a ribbon rewind spool 46 on rewind spindle 48. As will be described in more detail with reference to FIGS. 4 and 5, ribbon slack roller 42 moves rearward, as referenced to the forward movement of the liner 12, when print head assembly 14 and print head 20 are retracted into a dispensing position which prevents the thermal ribbon 36 from slacking when the print head assembly retracts.

Figure 2:
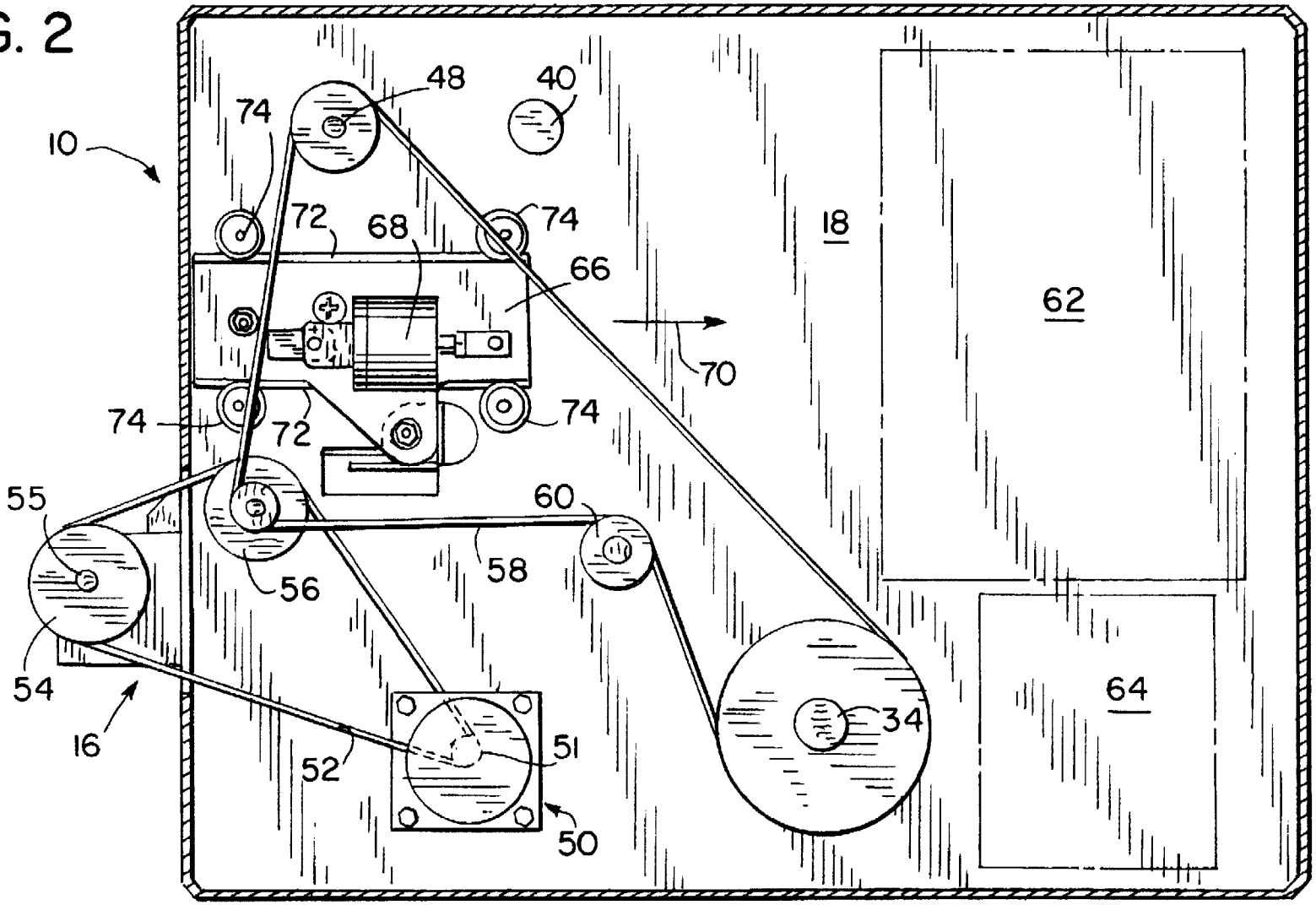
FIG. 2 is a view of the backside of the printer and dispenser of FIG. 1.

Referring to FIG. 2, the backside of the printer and dispenser assembly 10 is shown. Motor 50 is preferably a stepper motor for advancing each label a predetermined distance, as determined by the length of the particular labels to be printed. Motor 50 is connected to a drive pulley 51 for driving a first timing belt 52, which in turn drives a dispenser drive pulley 54 of dispenser 16, and a second timing belt drive pulley 56, which drives a second timing belt 58. Second timing belt 58 drives the ribbon rewind spindle 48 and the label liner rewind spool 34. The second timing belt 58 also has an idler pulley 60 between the rewind spool 34 and the second timing belt drive pulley 56.

The print head 20 of FIG. 1 is mounted to slide plate 66, FIG. 2, which has a pneumatic slide cylinder 68 for sliding the print head rearward on frame assembly 18, as shown by arrow 70. Slide plate 66 has upper and lower V-tracks 72 and rollers 74 for movement of slide plate 66. The movement of slide plate 66 is described in more detail with reference to FIGS. 6 and 7.

The backside of the printer and dispenser assembly 10 also has an area for mounting a first circuit board 62 to frame 18 and an area for mounting a power supply and second circuit board 64 to frame 18. The circuit boards contain the microprocessor control and associated hardware.

Figure 3:
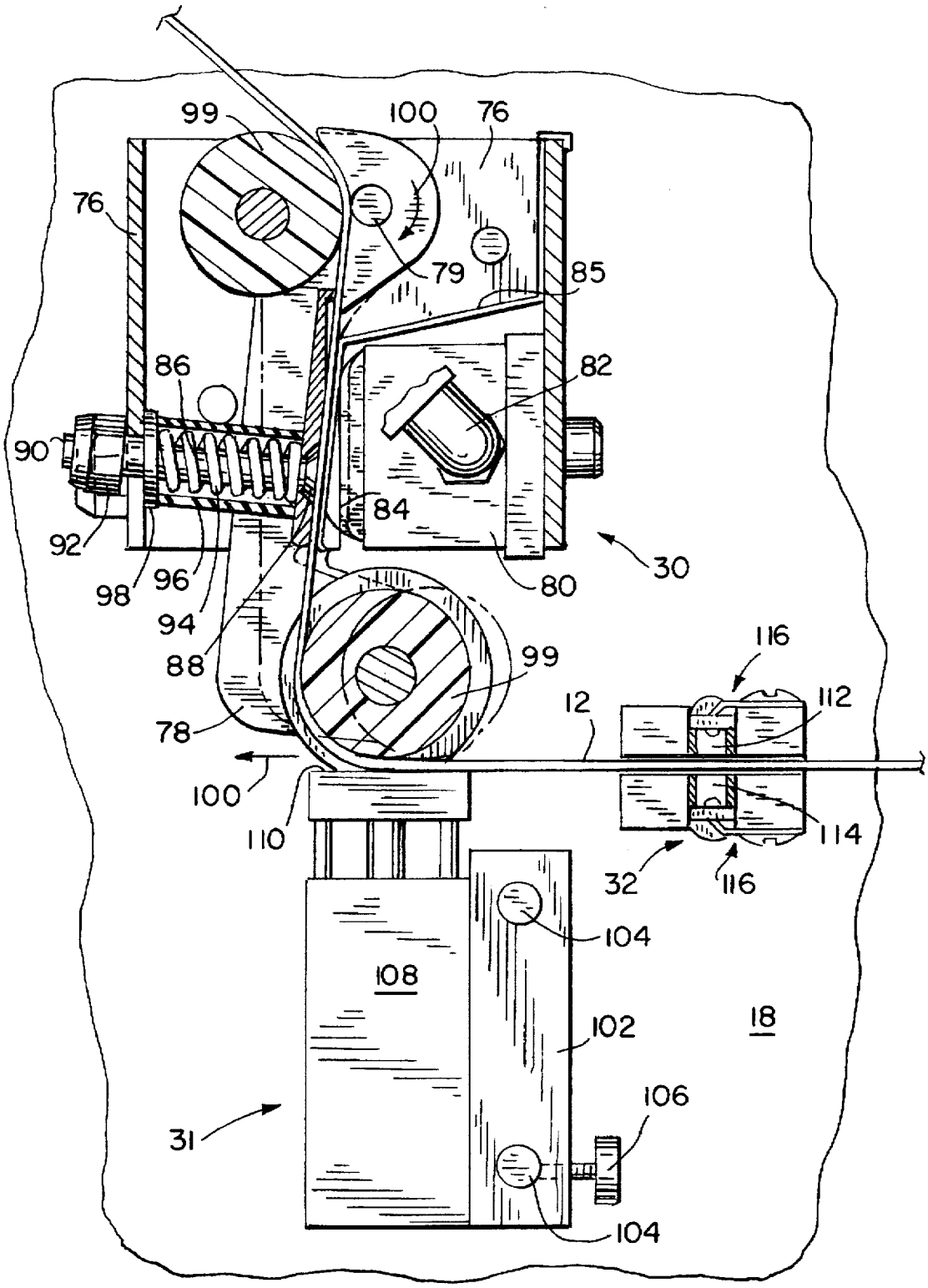
FIG. 3 is a detailed side view of a portion of FIG. 1.

FIG. 3 is a detailed view of a portion of FIG. 1, and more specifically that of the high web tensioner 30, the low web tensioner 31, and the label sensor 32. The high web tensioner 30 places high tension on the web during dispensing of labels. The low web tensioner 31 places a lower tension on the web during printing, and the label sensor 32 monitors label movement.

In the present preferred embodiment, the high web tensioner 30 is a brake assembly for preventing movement of the web and for tensioning the web prior to dispensing printed labels to maintain label placement accuracy. Brake assembly 30 has a fixed mounting bracket 76 and a roller bracket 78 which pivots about pivot pin 79. Brake assembly 30 also has a pneumatic clamping cylinder 80 having an air inlet 82 and an expandable bladder 84 attached to the fixed mounting bracket 76. A mask 85 is provided between the web 12 and the bladder 84 to protect the labels on the web. A guide rod 86, which has a flanged end 88 and a threaded end 90, is placed through roller bracket 78 and mounting bracket 76 with a lock nut 92 on threaded end 90. A compression spring 94, a stop collar 96, and a limit washer 98 are all placed about guide rod 86, and confined between roller bracket 78 and fixed mounting bracket 76. A pair of guide rollers 99 are provided at each end of the brake assembly 30 to guide web 12 through the brake assembly.

In operation, when it is desired to tension web 12 to strip and dispense a label, bladder 84 is inflated and exerts pressure against mask 85 and web 12 thereby rotating roller bracket 78 in a direction as indicated by arrows 100 which compresses compression spring 94 until all slack is removed from the liner. As is readily discernible, the amount of travel of roller bracket 78 is adjustable with the addition or deletion of additional limit washers 98. In addition to preventing the further advancement of web 12 from the supply roll, the travel of roller bracket 78 removes any existing slack from the web 12 at the dispenser. However, since some web materials may not introduce slack in web 12, the movement of roller bracket 78 in direction 100 may not be necessary, and brake assembly 30 may be replaced with a system in which bladder 84 inflates against a fixed stop as opposed to roller bracket 78.

FIG. 3 also shows a detailed view of the low web tensioner 31 in which a mounting block 102 is slidably attached to a pair of guide shafts 104 which are mounted to frame assembly 18. A stop screw 106 engages the lower guide shaft 104, and is used for adjusting the low web tensioner 31 with respect to a given web length. A pneumatic cylinder 108 is attached to mounting block 102 and has a friction pad 110 engageable with the non-label bearing side of web 12. In the preferred embodiment, friction pad 110 is a felt pad for placing low tension on web 12 while high web tensioner 30 is disengaged. Alternately, low web tensioner 31 could be replaced with a simpler device, such as a spring steel tensioner biased against the web.

FIG. 3 also shows the label sensor 32 for sensing labels and monitoring labels on the web 12. Label sensor 32 has an infrared transmitter 112 and an infrared detector 114, each held in place by a spring and set screw assembly 116. In this manner, the infrared detector 114 can monitor the passage of a label on web 12 when a transmission from infrared transmitter 112 passes through the thinner liner material between passing labels. The label sensor 32 ensures accurate registration and placement of printed labels.

Figure 4:
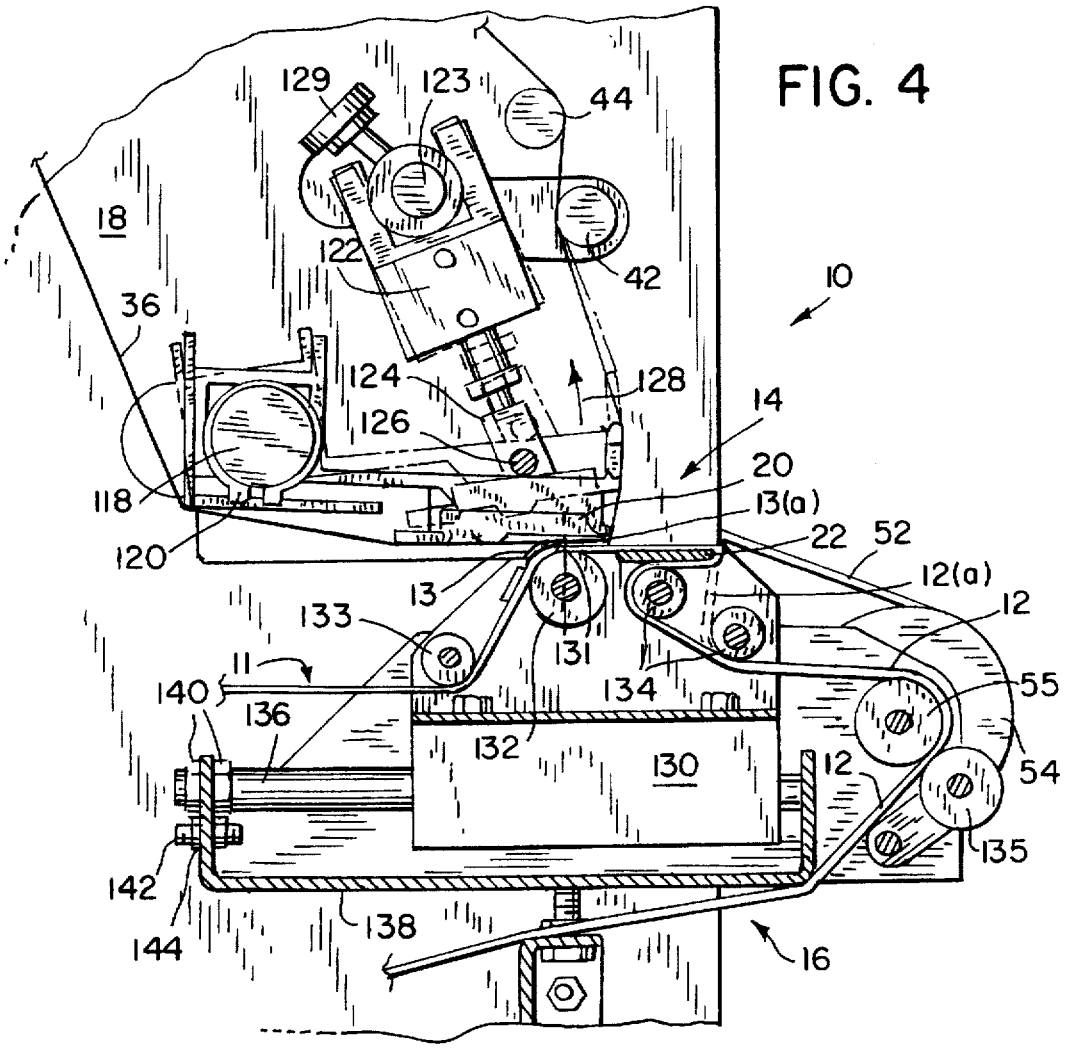
FIG. 4 is a detailed side view of a portion of FIG. 1 in a printing position.

Referring to FIG. 4, the print head assembly 14 and dispenser 16 are shown in detail, and each in a printing position. Print head assembly 14 has retractable print head 20 pivotally attached to frame assembly 18 through pivot pin 118 and retaining clip 120. Print head 20 is attached to a lift cylinder 122 by clevis 124 and clevis pin 126. Lift cylinder 122 is attached to slide plate 66, FIG. 2, by pivot pin 123, FIG. 4, and lifts print head 20 upward as shown by arrow 128 from a lowered printing position, on its way to a retracted dispensing position. A set screw 129 allows the print head to be adjusted according to the length of the labels to be printed on web 12. The advancement of a label across print head 20 from the position of label 13, referred to as the preprinting point, to the position of label 13(*a*), referred to as the fixed label dispensing point, results in the printing of information on label 13(*a*) by print head 20. Printed label 13(*a*) is then in position to be removed, and label 13 is in position to be printed.

Figure 8:
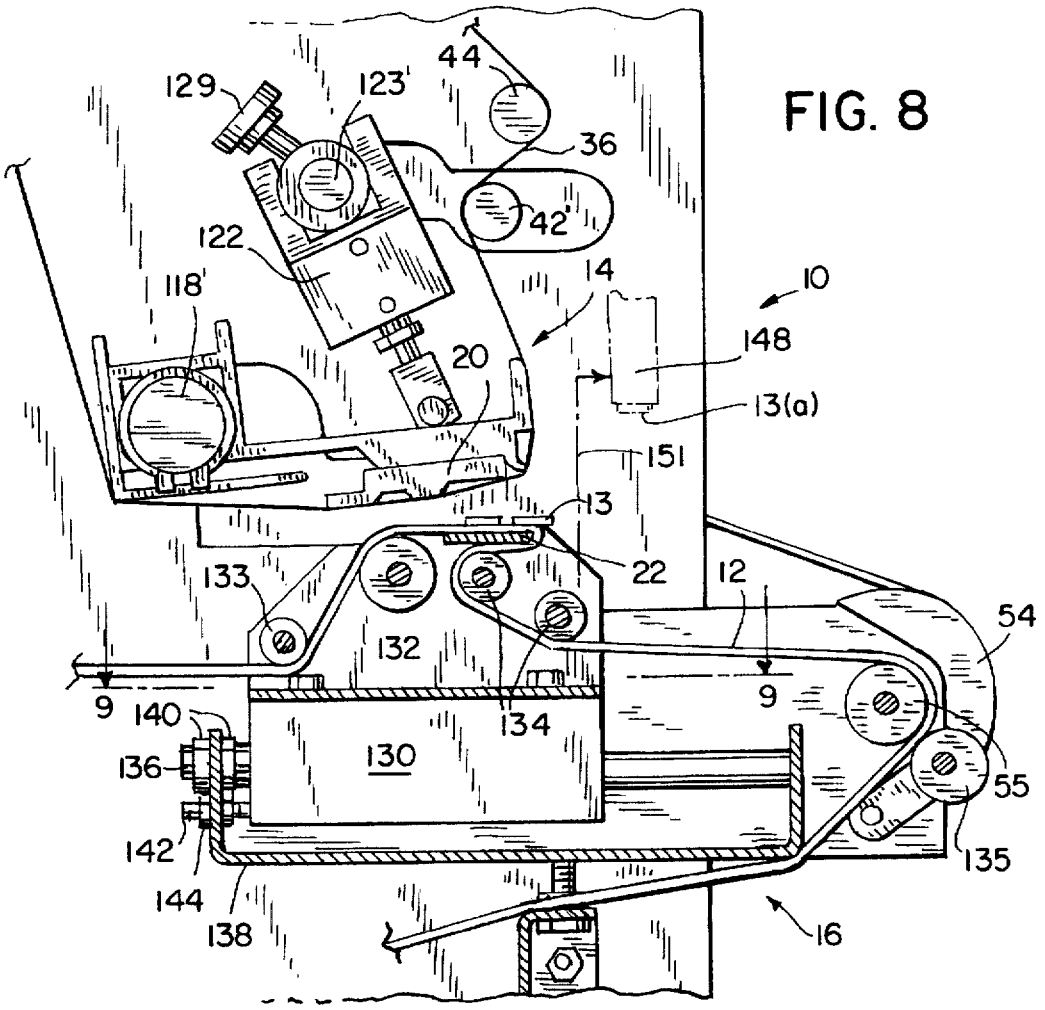
FIG. 8 is a side view similar to FIG. 5, but with the stripper plate in a dispensing position.

Dispenser 16 has stripper plate 22 attached to a slide block cylinder 130 for moving from a printing position to a dispensing position. As illustrated in FIG. 4, dispenser 16 is in a printing position while FIG. 8 illustrates the dispenser in a dispensing position, as will be described hereinafter in more detail. Dispenser 16 has a first idler roller 133 for guiding the web 12 to the platen roller in a substantially planar orientation to facilitate well-defined printing. Dispenser 16 also has a pair of secondary idler rollers 134 for guiding liner 12 around stripper plate 22 and to drive roller 55 which is driven by drive pulley 54 and the first timing belt 52. A pinch roller 135 is provided to pinch liner 12 against drive roller 55 for tensioning the liner during dispensing with the aforementioned brake assembly 30.

Dependent upon liner material 12, an alternate path for the liner after leaving stripper plate 22 is shown between the guide rollers 134 as shadowed liner 12(*a*). It is contemplated that the original path shown for liner 12 in the drawings may cause too much friction for some certain web materials, and may cause the timing belts to slip, or provide too much torque for the stepper motor. Such an alternate path for the liner will prevent such problems. For similar reasons, it is also contemplated that a small guide roller could be added to the end of the stripper plate 22 to assist the liner around the stripper plate during the stripping operation.

Dispenser 16 has platen roller 132 for receiving a label thereover while information is being printed on the label by print head 20. The location of the platen roller 132 defines the print line 131, which is centered vertically about platen roller 132 when dispenser 16 remains in the printing position as is shown in FIG. 4. Slide block 130 moves laterally on actuating shaft 136 which is held to a dispenser frame 138 with a pair of locking nuts 140 at one end of the actuating shaft 136. The location of platen roller 132 is adjustable, with respect to label 13 on web 12, with locking nuts 140 which limit the travel of slide block cylinder 130 in the printing position. A set screw 142 and lock nut 144 limit the travel of slide block cylinder 130 in its rearward, dispensing position.

Figure 5:
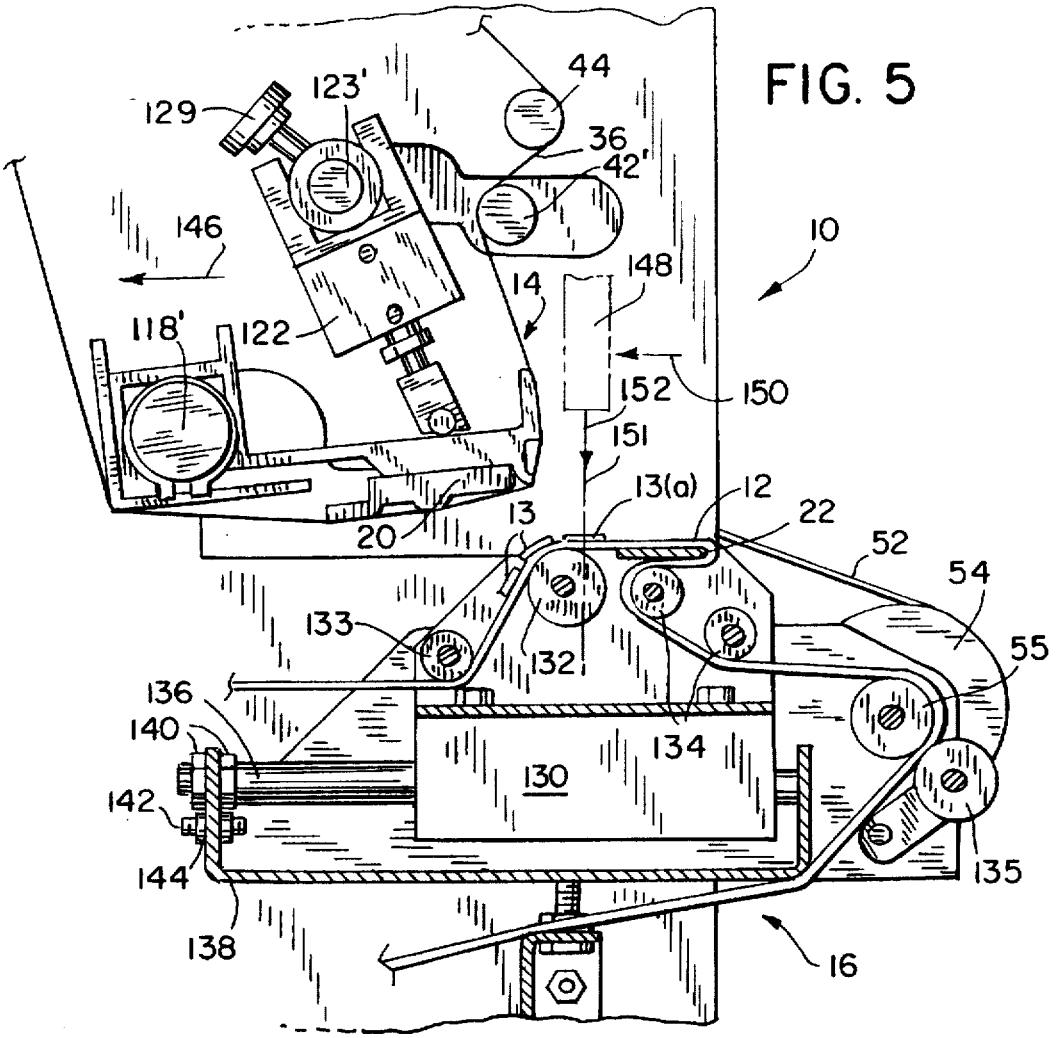
FIG. 5 is a detailed side view similar to FIG. 4, but with the print head in a dispensing position.

FIG. 5 shows in print head assembly 14 its dispensing position having print head 20 pivoted upward by lift cylinder 122 about pivot pin 118, and the entire print head assembly 14 slid rearward as shown by arrow 146 by motion of slide plate 66, FIG. 2, in the direction as indicated by arrow 70. Referring back to FIG. 5, with print head assembly 14 in its dispensing position, a transfer device 148 can be moved into position as indicated by arrow 150, and then moved downward as indicated by arrow 152 and placed in positive contact with a printed label 13(*a*). When the transfer device is first placed on the printed label 13(*a*), the printed label is still on liner 12 and on stripper plate 22. At this time, the transfer device 148 and the printed label 13(*a*) are at a fixed label dispensing point 151, which defines where labels are stripped from liner 12 and dispensed. FIG. 5 shows dispenser 16 remaining in the printing position to allow rigid support for printed label 13(*a*) as transfer device 148 is brought into contact with the printed label which remains at the fixed label dispensing point 151.

Figure 6:
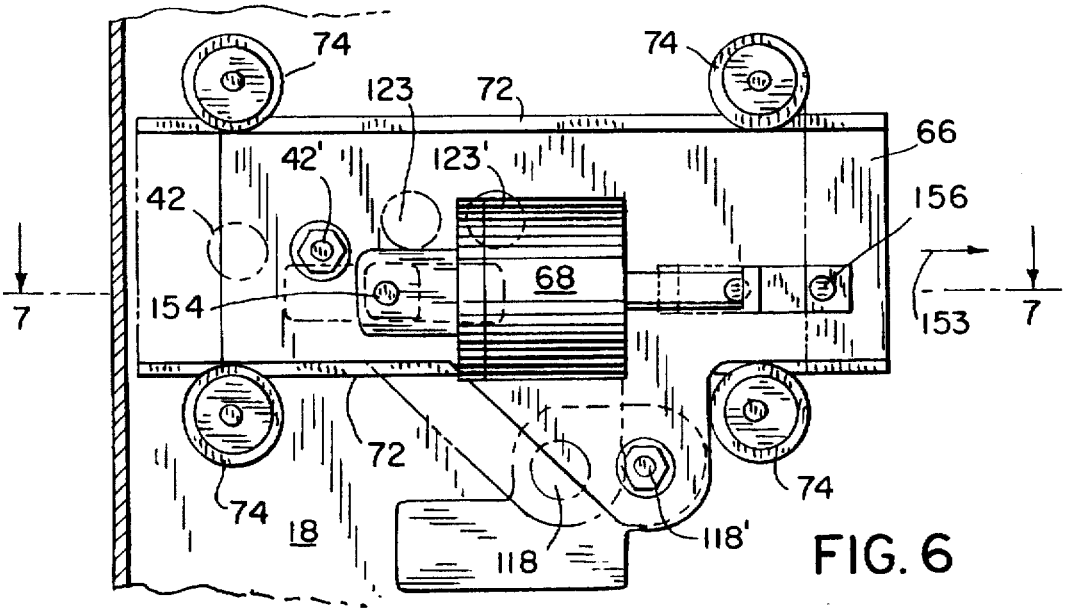
FIG. 6 is a detailed side view of a portion of FIG. 2.

FIG. 6 shows the movement of slide plate 66 as indicated by arrow 153 from a printing position (shadowed) of print head assembly 14, as is shown in FIG. 4, to a dispensing position, as is shown in FIG. 5. Movement of slide plate 66, also causes ribbon slack roller 42 to move from its printing position, shown as 42' in FIG. 6, to a dispensing position shown in FIG. 5, effectively taking up any slack in ribbon 36 when print head assembly 14 moves to its dispensing position, as previously mentioned.

Figure 7:
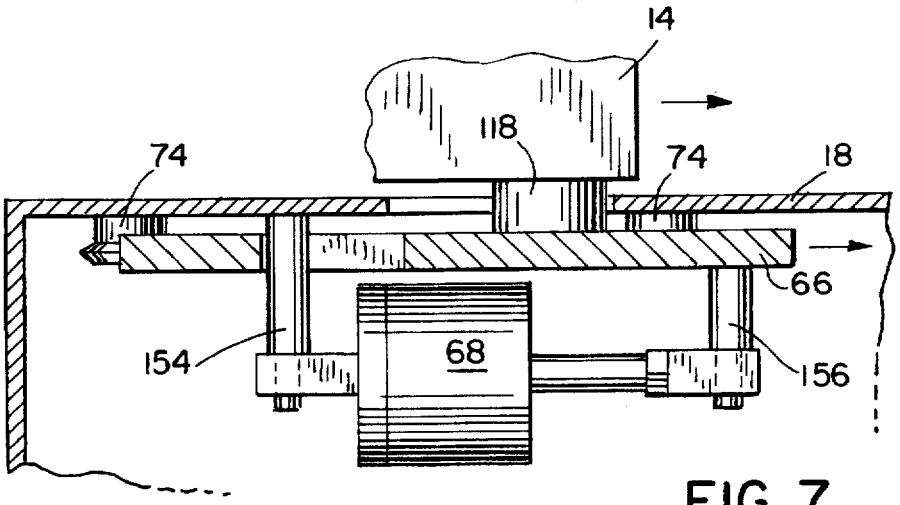
FIG. 7 is a top plane view taken along line 7—7 of FIG. 6.

FIG. 7 is a top view of slide plate 66 and slide cylinder 68 taken along line 7—7 of FIG. 6. As best seen in FIG. 7, slide cylinder 68 is attached to frame 18 with pin 154, and is attached to slide plate 66 with pin 156. FIG. 7 shows slide plate 66 and print head assembly 14 in the dispensing position.

Referring to FIG. 8, transfer device 148 is shown removing printed label 13(*a*) with dispenser 16 and stripper plate 22 in their dispensing positions. It is important to note that the movement of stripper plate 22 does not affect the relative placement of printed label 13(*a*) when it is stripped from the liner at the fixed label dispensing point 151. The transfer device 148 is placed in positive contact with printed label 13(*a*), then the stripper plate 22 is retracted to strip liner 12 from label 13(*a*). Also, the next unprinted label 13 is partially exposed from liner 12 when stripper plate 22 is retracted, or is in its dispensing position. It has been found that this exposure eases the subsequent removal of the printed label 13(*a*) by the transfer device, even though when stripper plate 22 returns to the dispensing position, as shown in FIG. 4, the liner is brought back into contact with the unprinted label 13. Set screw 142, FIG. 8, of print head assembly 14 provides adjustment to slide block cylinder 130 and stripper plate 22, to determine the amount of exposure of unprinted label 13. Set screw 142 can be adjusted to eliminate any exposure, or provide various amounts of exposure dependent upon the size of the labels being printed, the types of materials used for the labels, and/or the liner material.

Figure 9:
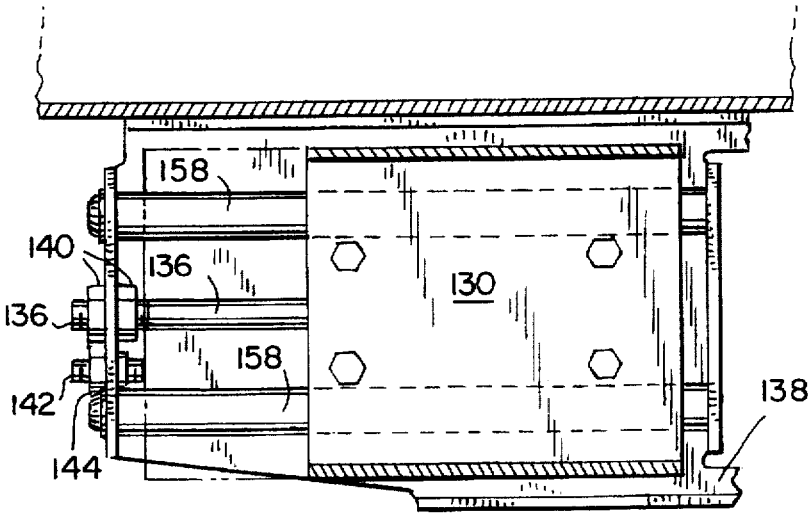
FIG. 9 is a top plane view taken along line 9—9 of FIG. 8.

FIG. 9 shows a top view of a portion of the dispenser 16. The sliding block 130 is shown in its printing position, and shadowed in its dispensing position. Slide block 130 is moved about dispenser frame 138 by actuating shaft 136 and is guided by guide shafts 158.

The following is a description of the printing and dispensing operation with reference to FIGS. 4, 5, and 8. With reference to these figures, and the description of the pre-printing point and fixed label dispensing point, it is understood that with varying label sizes, the reference points may vary or be adjusted accordingly. Referring to FIG. 4, an unprinted label 13 is in a pre-printing position about to cross platen roller 132 and print head 20. Print head assembly 14 and dispenser 16 are in their printing positions, and the stepper motor, driving timing belt 52, advances web 12 across print line 131 from the pre-printing point to a fixed label dispensing point indicated by label 13(*a*). As label 13 passes across print head 20, the print head prints information on the label as it moves across platen roller 132. The lift cylinder 122 then lifts print head 20 upward, pivoting the print head about pivot pin 118.

Print head assembly 14 is then slid rearward as shown by arrow 146 in FIG. 5. This allows access by transfer device 148 to the printed label 13(*a*) at the fixed label dispensing point 151. At which time web 12 is tensioned across the fixed label dispensing point. In the preferred embodiment, the tensioning is accomplished by pinching the liner 12 between drive roller 55 and pinch roller 135, and activating brake assembly 30, as shown and described with reference to FIG. 3. The transfer device 148 is then brought into contact with the printed label 13(*a*) as shown by arrow 152 while the label is still attached to liner 12. This ensures accurate placement onto the transfer device before peeling the liner from the label.

FIG. 8 shows dispenser 16 and stripper plate 22 retracted to their dispensing positions wherein stripper plate 22 strips liner 12 from printed label 13(*a*), and preferably, partially exposes unprinted label 13 from liner 12. Transfer device 148 then removes the printed label from the printer and dispenser assembly 10 and proceeds to apply the printed label to an article (not shown). Slide block 130 and print head assembly 14 then return to their printing positions, as shown in FIG. 4, wherein the system proceeds to print another label.

The present invention also contemplates the method of printing and dispensing labels from a label liner having a series of labels adhesively attached. The method includes establishing the fixed label dispensing point and step-wise advancing an unprinted label on the label liner across the print head and onto the stripper plate, thereby placing the label in alignment with the fixed label dispensing point. Information is printed on the label as the label is advanced across the print head. The method also includes moving the print head sufficiently away from the fixed label dispensing point to provide access to the printed label, and then tensioning the label liner across the fixed label dispensing point, and placing the transfer device on the printed label at the fixed label dispensing point. The method then includes sliding the stripper plate in an opposite direction as that of the label liner advancement, thereby peeling the label liner from the printed label while maintaining the printed label at the fixed label dispensing point. In general terms, the final step to the method involves removing the transfer device with the printed label attached thereto, from the label dispensing point of the printer and dispenser assembly.

The method contemplates including sliding the stripper plate far enough to at least partially expose the next label to be printed on the label liner, thereby assisting the step of peeling the label liner in a following printing and dispensing iteration. The step of moving the print head sufficiently away from the fixed label dispensing point includes pivoting the print head upward and sliding the print head rearward, such that the printed label remains at the fixed label dispensing point without further movement of the liner, but at the same time being accessible by the transfer device.

The step of step-wise advancing the label liner includes advancing the label liner by at least one label length across the platen roller of the dispenser to the fixed label dispensing point. The step of tensioning the label liner is further defined as nipping the drive roller of the dispenser at one end of the fixed label dispensing point, and pinching the label liner on the other end of the fixed label dispensing point. After removing the transfer device with the printed label attached thereto from the fixed label dispensing point, the print head and stripper plate are returned to their printing positions, and high tension is released from the label liner to proceed with printing another label.

Although the invention has been described in terms of the preferred embodiment, it is recognized that equivalence, alternatives, and modifications, aside from those expressly stated, are possible and within the scope of the appended claims.

We claim:

1. A printer and dispenser assembly for printing labels on a label liner and dispensing the printed labels from the label liner comprising:

a frame assembly referencing a fixed label dispensing point;

a supply spool capable of having a supply roll of label liner thereon, the label liner having a series of labels removably attached;

a rewind spool capable of receiving the label liner;

a motor for unwinding the label liner from the supply spool and rewinding the label liner on the rewind spool, wherein the motor advances each label from a preprinting point to the fixed label dispensing point;

a retractable print head attached to the frame assembly, wherein the print head prints information on a label passing from the preprinting point to the fixed label dispensing point while the print head is in a printing position, having means for allowing access to the printed label at the fixed label dispensing point by a transfer device while the print head is in a dispensing position; and a dispenser having a stripper plate slidably attached to the frame assembly having means for receiving the printed label from the print head while in a printing position, and stripping the liner from the label while moving to a dispensing position to allow removal of the printed label by the transfer device.

2. The printer and dispenser assembly of claim 1 wherein the print head pivots upward and slides rearward on the frame assembly when moving from the printing position to the dispensing position.

3. The printer and dispenser assembly of claim 1 further comprising a label liner tensioner for tensioning the label liner across the fixed label dispensing point.

4. The printer and dispenser assembly of claim 3 wherein the label liner tensioner comprises a drive roller and a pinch roller for nipping the label liner at one side of the fixed label dispensing point, and a brake assembly for pinching the label liner at an other side of the fixed label dispensing point.

5. The printer and dispenser assembly of claim 4 wherein the brake assembly comprises a pneumatic bladder inflatable against the label liner and a stop.

6. The printer and dispenser assembly of claim 4 wherein the brake assembly is rotatably mounted to the frame assembly, and pivots while pinching the label liner to place tension on the label liner at the fixed label dispensing point.

7. The printer and dispenser assembly of claim 1 wherein the dispensing position of the stripper plate at least partially exposes the label liner from an unprinted label located at the preprinting point.

8. The printer and dispenser assembly of claim 1 further comprising a stripper plate support bracket attached to the frame assembly, wherein the stripper plate is mounted to a pneumatic slide block having an actuating rod attached to the support bracket, the support bracket having a set-screw facing the slide block for adjusting the amount of stripper plate travel from the printing position to the dispensing position.

9. The printer and dispenser assembly of claim 8 wherein an adjustment to the set-screw varies the dispensing position of the stripper plate which varies an amount of exposure of an unprinted label from the label liner located at the preprinting point.

10. The printer and dispenser assembly of claim 1 wherein the motor is further defined as a stepper motor for advancing each label from a preprinting point to the fixed label dispensing point.

11. The printer and dispenser assembly of claim 1 further comprising a label sensor monitoring labels on the label liner.

12. The printer and dispenser assembly of claim 1 further comprising a low tension device in contact with the label liner to limit slack in the label liner.

13. The printer and dispenser assembly of claim 1 further comprising a lift cylinder attached to the frame assembly and the print head for pivoting the print head upward.

14. A method of printing and dispensing labels from a label liner having a series of labels thereon, comprising the steps of:

establishing a fixed label dispensing point;

step-wise advancing a label on the label liner across a print head and onto a stripper plate thereby placing the label in alignment with the fixed label dispensing point;

printing information on the label as the label liner is advanced through the print head;

moving the print head sufficiently away from the fixed label dispensing point to provide access to the printed label;

tensioning the label liner across the fixed label dispensing point;

placing a transfer device on the printed label at the fixed label dispensing point;

sliding the stripper plate in an opposite direction as that of the label liner advancement thereby peeling the label liner from the printed label while maintaining the printed label at the fixed label dispensing point; and removing the transfer device with the printed label attached thereto from the fixed label dispensing point.

15. The method of claim 14 wherein the step of sliding the stripper plate is further defined to at least partially expose the next label to be printed on the label liner, thereby assisting the step of peeling the label liner in a following printing and dispensing iteration.

16. The method of claim 14 wherein the step of moving the print head is further defined as pivoting the print head upward and sliding the print head rearward.

17. The method of claim 14 wherein the step of step-wise advancing the label liner is further defined as advancing the label liner by at least one label length.

18. The method of claim 14 wherein the step of tensioning the label liner further comprises the steps of nipping a drive roller having the label liner thereabout at one side of the fixed label dispensing point, and pinching the label liner on a second side of the fixed label dispensing point.

19. The method of claim 18 wherein the step of pinching the label liner further comprises inflating a bladder against a fixed plate having the label liner therebetween and further comprising the step of removing slack from the label liner across the fixed label dispensing point.

20. The method of claim 14 further comprising the steps of returning the print head and the stripper plate to a printing position, and relieving tension from the label liner.

* * * * *